US006089814A

United States Patent [19]

Bayer

[11] Patent Number: 6,089,814

[45] Date of Patent: Jul. 18, 2000

[54] DEVICE FOR RIPPING AND TEARING BAGS OPEN

[76] Inventor: Manfred Bayer, Herrengarten 26, 49545 Tecklenburg, Germany

[21] Appl. No.: 09/196,311

[22] Filed: Nov. 19, 1998

[30] Foreign Application Priority Data

Nov. 15, 1997 [DE] Germany ..... 197 50 574

[51] Int. Cl.[7] ..... B65B 69/00

[52] U.S. Cl. ..... 414/412; 241/191; 241/DIG. 38

[58] Field of Search ..... 414/412; 241/187, 241/189.1, 191, DIG. 38

[56] References Cited

U.S. PATENT DOCUMENTS

| | | | |
|---|---|---|---|
| 2,818,985 | 1/1958 | Irmscher | 414/412 |
| 4,034,877 | 7/1977 | Bennison | 414/412 |
| 5,484,247 | 1/1996 | Clark et al. | 414/412 |
| 5,551,825 | 9/1996 | Montgomery | 414/412 |
| 5,564,881 | 10/1996 | Campbell | 414/412 |
| 5,762,463 | 6/1998 | Bielagus | 414/412 |

FOREIGN PATENT DOCUMENTS

| | | | |
|---|---|---|---|
| 686562 | 12/1995 | European Pat. Off. | 414/412 |
| 43 31 310 | 3/1995 | Germany | 414/412 |

*Primary Examiner*—Robert P. Olszewski
*Assistant Examiner*—Gerald J. O'Connor
*Attorney, Agent, or Firm*—Horst M. Kasper

[57] ABSTRACT

A device for tearing and ripping bags comprising a plurality of driven, endless rotary support elements supporting tearing and ripping elements, wherein the rotary support elements are disposed sequentially along the axis of rotation. A plurality of covering and/or stripping elements is in each case disposed at least at one of the neighboring rotary support elements and the covering and/or stripping elements overlap at least in part a sequentially neighboring rotary support element. The covering and/or stripping elements on a rotary support element are aligned with the tangential motion advance direction in order to improve the device for preventing that long, tear-resistant pieces end up in the slot between the rotary support elements and bring the ripping device to a standstill based on a winding-up long tear-resistant pieces. For this purpose, the covering and/or stripping elements are disposed at a distance relative to each other.

20 Claims, 3 Drawing Sheets

DEVICE FOR RIPPING AND TEARING BAGS OPEN

BACKGROUND OF THE INVENTION

1. Field of the Invention

The invention relates to a device for ripping and tearing bags and/or for opening bags, wherein the device includes a plurality of driven, endless rotary support elements supporting ripping projections, wherein the rotary support elements are disposed sequentially along the axis of rotation.

2. Brief Description of the Background of the Invention Including Prior Art

Such a ripping device is known for example from the European printed patent document EP 0,686,562-A1 and has proven to be useful in practice. Bags are ripped open with this device in a surprisingly simple way. Jammings and windings of accompanying materials around the ripping drum are also excluded. However, a content of the bags of long and tear-resistant pieces presents problems, such as hemp strings or video tapes. These pieces end up in part in the slot between the rotary support elements.

SUMMARY OF THE INVENTION

1. Purposes of the Invention

It is an object of the present invention to improve the ripping devices to prevent that ripping-resistant, long pieces end up in a slit between the rotary support elements and that the ripping device is brought to a standstill based on winding-up long tear-resistant pieces.

These and other objects and advantages of the present invention will become evident from the description which follows.

2. Brief Description of the Invention

The present invention provides for a device for ripping bags open. Tearing and ripping elements are supported on a plurality of endless rotary support elements. The rotary support elements are disposed in an axial direction closely next to each other. A plurality of covering and/or stripping elements are disposed at least at one of the plurality of the rotary support elements. Each of the plurality of the covering and/or stripping elements at least in part overlaps another rotary support element disposed neighboring to said one of the plurality of the rotary support elements.

The covering and/or stripping elements can be disposed at a distance relative to each other on said one of the plurality of the rotary support elements.

The distance between the covering and/or stripping elements can be smaller than their length in a tangential motion advance direction of the rotary support elements.

The distance between the covering and/or stripping elements can be larger than their length in a tangential motion advance direction of the rotary support elements.

A plurality of covering elements and/or stripping elements is disposed in each case at least at one of the neighboring support elements, wherein the covering elements and/or stripping elements overlap at least in part a sequentially neighboring rotary support element relative to a direction aligned with the rotation axis. The slot between the neighboring rotary support elements is covered with these covering and/or stripping elements up to such a point that it is prevented that long, ripping-resistant objects, such as for example hemp string and video tapes, can be drawn through the slot between sequentially neighboring rotary support elements into the interior of the ripping and tearing device.

These ripping-resistant objects then come to rest on the covering and stripping elements and cannot be drawn into the interior of the drum formed by the rotary support elements. In addition, the areas of the rotary support elements neighboring sequentially in axial direction are kept clean with the front stripping edge of the stripping elements relative to a tangential motion advance direction such that it is prevented that pieces pass into the interior of the drum. Rather, the tear-resistant pieces are pushed out of the critical region with the covering elements and/or stripping elements.

A particularly good stripping and cleaning effect is achieved in that the covering elements and/or stripping elements are disposed at a distance from one another. The jam-free operation with the accompanying self-cleaning is only achieved based on the fact that the covering elements and/or stripping elements are not formed as circumferential rings but by circumferentially sequentially arranged elements, disposed at a distance from one another thereby forming elements sequentially arranged as an interrupted ring, representing a saw-like organized sequence. A circumferentially arranged full ring does provide the desired effect in many cases, but jammings occur even more frequently, as tests have shown. In a completely surprising way, only the sawtooth-like arrangement formation and disposition of the stripping elements and/or covering elements brings about the breakthrough for the production of a jam-free operating device. For this purpose, the distance between the covering elements and/or stripping elements can be larger and/or smaller than the length of the covering elements and/or stripping elements in the tangential motion advance direction of the rotary support elements.

A particularly good stripping effect is achieved in that the covering elements and/or stripping elements are bevelled or canted at their front side relative to the tangential motion advance direction and in fact such that their front side runs inclined or, respectively, obliquely curved and/or slightly arc-shaped towards the rear from about the attachment side relative to the tangential motion advance direction. Overall the covering elements and/or stripping elements have a substantially trapezoidal shape with the base of the trapezoid attached to the rotary support elements along a line on the outer surface of the rotary support element extending in tangential motion advance direction. The adhering pieces are pushed away from the slot between neighboring rotary support elements toward the center of the rotary support element based on this measure.

The curvature or canting of the front side of the covering elements and/or stripping elements can be linear and/or curved or, respectively, slightly arc-shaped.

The covering elements and/or stripping elements are curved or canted with the radii of curvature disposed perpendicular to the tangential motion advance direction relative to their two-dimensional extension area and in fact such that their two-dimensional extension area runs inclined or, respectively, obliquely curved and/or slightly arc-shaped substantially along a direction parallel to the rotation axis when going from the attachment side to the side overlapping the neighboring rotary support element. The top edge of the trapeze shape is thereby elastically maintained in close spacing or contact with the neighboring rotary support element.

The curvature or canting of the two-dimensional extension area can be linear and/or curved or, respectively, slightly arc-shaped.

In order to achieve a friction as low as possible between the covering elements and/or stripping elements and the neighboring rotary support element, it is provided that the covering elements and/or stripping elements are formed arch-shaped, convex-shaped, dome-shaped and/or gable-shaped in the cross-section as seen in the direction of tangential advance motion.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
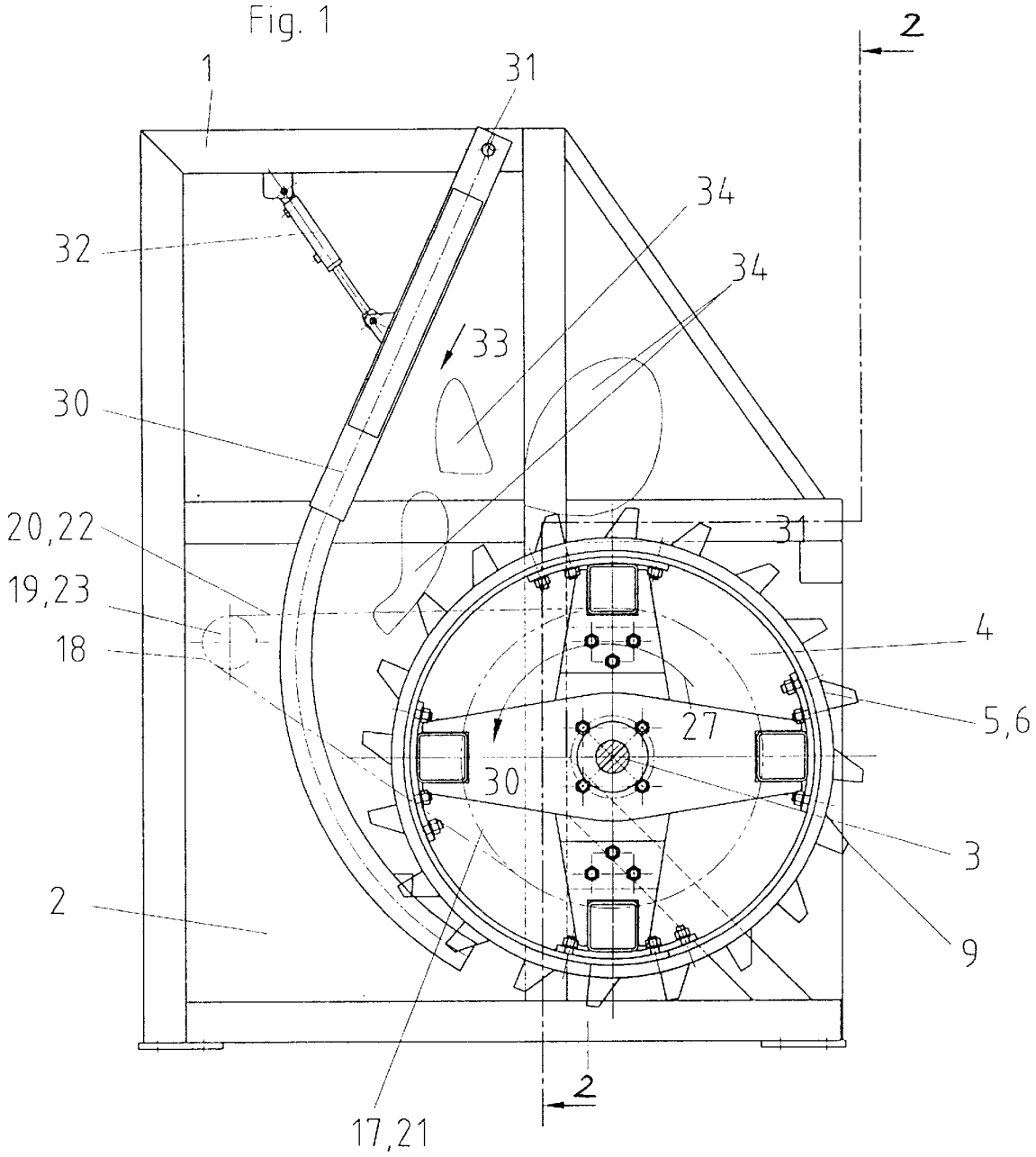
FIG. 1 is a side view of a device for tearing and ripping bags.
Figure 2:
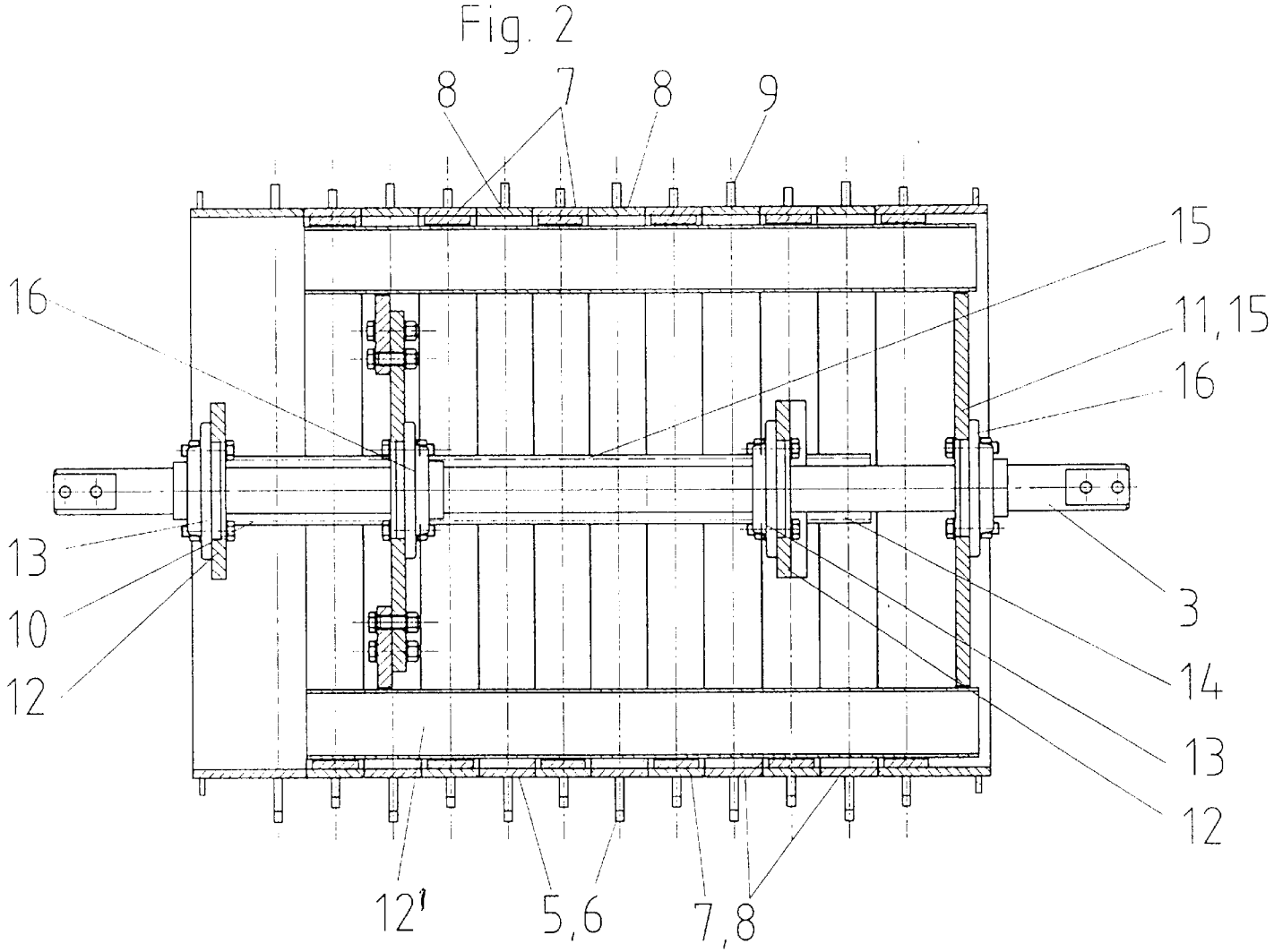
FIG. 2 is a sectional view of the device for tearing and ripping bags along section line 2—2 of FIG. 1.
Figure 3:
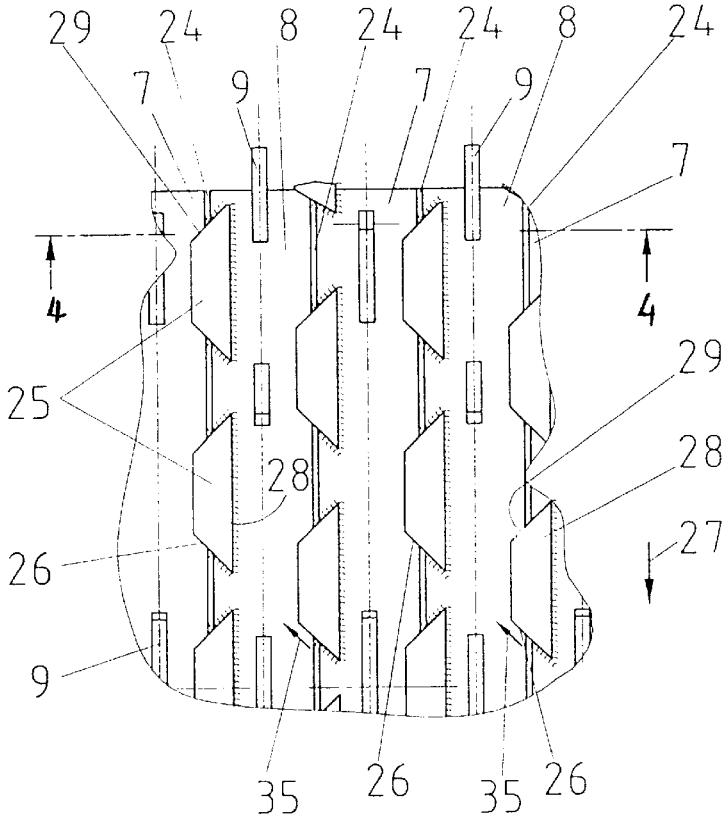
FIG. 3 is a view of the disposition of the covering elements and/or stripping elements at two neighboring rotary support elements.
Figure 4:
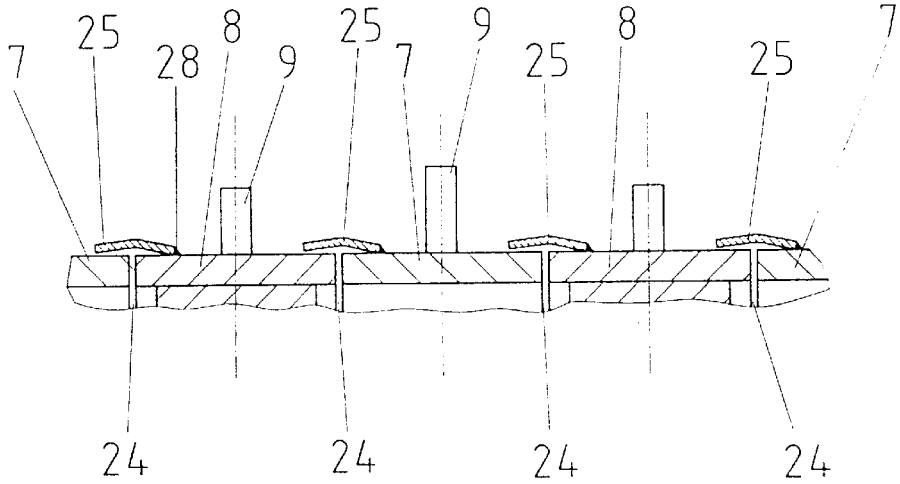
FIG. 4 is a sectional view of the disposition of the covering elements and/or stripping elements at neighboring rotary support elements along section line 4—4 of FIG. 3.

The device for ripping and tearing bags includes a frame 1, wherein the frame 1 is clad laterally with suitable wall parts 2. A shaft 3 is disposed at the frame 1. The ripping drum 4, formed as a drum-like element, is disposed on said shaft 3. The ripping drum 4 is formed of two drums 5 and 6 of annular strips 7, 8, said annular strips 7, 8 formed as rotary support elements, wherein the ripping elements 9 are disposed on the strips 7 and 8 of the strip drums 5 and 6. The two strip drums 5 and 6 are independently rotatably disposed on the shaft 3. Each strip drum 5 and 6 is comprised of the circumferential cylinder-shaped strips 7 or, respectively, 8, wherein the strips 7 and 8 are fixedly screwed to a supporting frame 10 or, respectively, 14. The first supporting frame 10 of the first strip drum 5 is comprised of braces 11, 12 and support rails 12', running parallel to the shaft 3. The braces 12 are disposed rotatably on the shaft 3 by means of a bearing 13. The second strip drum 6 is comprised of strips 8, attached to a second supporting frame 14. The supporting frame 14 is comprised of braces 15 and support rails 15'. The braces 15 are also rotatably supported on the shaft 3 with a bearing 16. A driving toothed wheel 17 is attached at the outer brace 12 of the first strip drum 5, wherein the driving toothed wheel 17 is force-matchingly connected with a driving chain to a driving toothed wheel 18 of a first hydraulic motor 19. The outer brace 15 of the second strip drum 6 is force-matchingly connected with a driving wheel 21, wherein the driving wheel 21 is also connected force-matchingly with, for example, a driving chain connection 22 to a second hydraulic motor 23.

The covering and/or stripping elements 25 can be bevelled on their front edge 26 crosswise to their tangential motion advance direction 27 and in fact such that the front edge 26 of the covering and/or stripping elements 25 relative to the tangential advance motion direction runs in each case from about their attachment side 28 obliquely toward the back or, respectively, obliquely curved and/or slightly arc-shaped toward the back, relative to their tangential motion advance direction 27.

The covering and/or stripping elements 25 can be bevelled on their back edge 29 crosswise to their tangential motion advance direction and in fact such that the back edge 29 of the covering and/or stripping elements 25 relative to the tangential advance motion direction runs in each case from about their attachment side 28 obliquely toward the front or, respectively, obliquely curved and/or slightly arc-shaped toward the front, relative to their tangential motion advance direction 27.

The covering and/or stripping elements 25 can be formed arched-shaped, convex-shaped, dome-shaped and/or gable-shaped in the cross-section as seen in the tangential motion advance direction 27.

A small slot 24 is disposed in each case between neighboring strips 7 and 8 of the respective strip drums 5 and 6 for production purposes. Covering and stripping elements 25 are disposed on the strips 7 at a distance relative to each other. These covering and stripping elements 25 serve as entanglement protectors for the strips 7, 8. These covering and stripping elements 25 overlap in part the respective neighboring strip 8 of the other strip drum crosswise to the tangential motion advance direction of the strip drums and parallel to the direction of the rotation axis of the shaft 3 of the drums 5, 7. The covering and stripping elements 25 are bevelled at their front side edge 26 crosswise to the tangential motion advance direction 27 and in fact such that the front side edge 26 of the covering and stripping elements 25 runs in each case from the attachment side 28 obliquely toward the back relative to the tangential motion advance direction 27 of the rotary support elements and of the covering and stripping elements 25. The covering and stripping elements 25 are bevelled at their back side edge 29 crosswise to the tangential motion advance direction and in fact such that the back side edge 29 of the covering and stripping elements runs in each case from the attachment side 28 obliquely toward the front. The bevel angle can be from about 30 to 60 degrees and is preferably from about 40 to 50 degrees.

The covering and stripping elements 25 are formed slightly arched-shaped, convex-shaped, dome-shaped and/or gable-shaped in the cross-section as seen in the tangential motion advance direction 28. The dome angle can be from about 5 to 20 degrees and is preferably from about 8 to 15 degrees.

The covering and stripping elements 25 can be of a trapezoidal shape and preferably of a symmetrical trapezoidal shape. The base line and the top line of the trapezoid are disposed sequentially relative to the rotation axis and are disposed substantially parallel to the tangential motion advance direction of the drums 5, 6. The base line of the trapezoid is preferably attached to the outer face of a respective strip 7, 8 and the top of the trapezoid is movable along the outer surface of a respective neighboring strip 7, 8. Preferably, the complete edge of the covering and stripping element 25, overlapping the respective strip 7, 8, is attached to this strip 7, 8. The base and the top of the trapezoid are disposed more or less flush with the neighboring outer face of a respective strip 7, 8. Thus, the two-dimensional extension of the covering and stripping elements 25 substantially follows the neighboring outer faces of the respective strips 7, 8.

The number of stripping elements and covering elements 25 along a single rotary support element can be from between one to two times the number of the ripping elements 9 associated with the said rotary support element. The number of covering and stripping elements 25 along a single rotary support element or strip 7, 8 can be from about 10 to 50 and is preferably between 20 and 40. The covering and stripping elements 25 along a single rotary support element or strip 7, 8 are preferably aligned along a circular line and preferably the drum axis provides a geometric rotation axis relative to the rotation axis of the respective drum. The maximum extension of the covering and stripping elements 25 in tangential motion advance direction can be from about 0.5 to 1 times the axial extension of a single strip 7, 8. The space between two neighboring trapezoids on a certain strip 7, 8 at the level of half height of the trapezoids can be from about 0.5 to 2 times the half height length of the trapezoids and is preferably from about 0.9 to 1.1 times the half height length of the trapezoids.

The axial extension of the covering and stripping elements 25 can be from about 0.2 to 0.5 times the axial extension of the respective strip 7, 8 and is preferably from about 0.3 to 0.4 times the axial extension of the respective strip 7, 8. The overlap in axial direction of the covering and stripping element 25 with the respective strip 7, 8 to which it is attached can be from about 0.3 to 0.6 times the axial extension of the covering and stripping element 25 and is preferably from about 0.4 to 0.5 times the axial extension of the covering and stripping element 25. The overlap in axial direction of the covering and stripping element 25 with the respective neighboring strip 7, 8 to which it is overlapping but not attached can be from about 0.3 to 0.6 times the axial extension of the covering and stripping element 25 and is preferably from about 0.4 to 0.5 times the axial extension of the covering and stripping element 25.

The covering and stripping element 25 is preferably made from a strong and tough material such as for example stainless steel and is preferably strongly attachable to the strips 7, 8.

In addition, countersupport elements 30 are disposed at the frame 1, where the countersupport elements 30 are formed of strips movable toward each other. In the exemplified embodiment (FIG. 1), the strips of the countersupport elements 30 are pivotably disposed at the frame 1 with a hinge arrangement 31 and are pressed with a hydraulic cylinder 32 or another spring element in the direction of the ripping drum 4. It is also possible to manufacture these movable strips of the countersupport elements 30 as a leaf spring or from an elastic material and to dispose then springily at the frame 1. In many cases, the counter support force, resulting from the weight force of the strips, is sufficient.

The strips of the countersupport elements 30 are hinged with the hinge arrangement 31 at their rear end, as seen in rotation direction 27 of the strip drum 5 and 6, at the frame 1. The front end is formed as a free end. The strips of the countersupport elements 30 have a shape similar to the shape of an elephant trunk or proboscis.

The ripping drum 4 and the countersupport elements 30 are disposed such that there results an upwardly opening funnel 33 between the ripping drum 4 and the countersupport elements 30, wherein the bags 34 to be torn and ripped are to be filled into the funnel 33.

The strip drums 5 and 6 are to be rotated relative to each other by an angle of 160° as resulting from the drawing and the construction of the strip drum 5 and 6 nested into each other. This results from the formation of the supporting frames 10 and 14, which supporting frames are nested in each other.

The ripping drum 4 is driven in the arrow direction 27 in order to rip apart the bags 34 to be filled into the ripping funnel 33. For this purpose, mainly only one of the strip drums 5 or, respectively, 6 rotates in each case during the respective rotary phases, whereas the other strip drum 5 or, respectively, 6 remains idle. The strip drums 5 and 6 are stepwise alternatingly further rotated by an angle of 180°, wherein the first phase and the last phase of the rotary phase overlap each other by an angle of about 20°. For this purpose the drive motors 19 and 23 are driven such that the first drive motor 19 remains idle in the first phase, which means that also the first strip drum 5 does not move. The second drive motor 23 rotates the second strip drum 6 by an angle of 160° during this first phase. Shortly before reaching the rotary motion over 180°, the first drive motor 19 is switched on, which means that both strip drums 5 and 6 of the ripping drum 4 rotate over a rotary phase angle of about 20°. This is advantageous because large braking and starting torques are avoided by this in that the energy during the braking of the one drum 5 or, respectively, 6 is used to start the other drum 5 or, respectively, 6. The second drive motor 23 is switched off after the end of one rotary phase of 180° of the first drum during the simultaneous rotation of the phase of about 20° and the first strip drum 5 is rotated by the first drive motor by about 160°, wherein the second drive motor 23 is then again switched on over a rotary phase angle of about 20°. Subsequently, the first drive motor 19 is switched off, and the second drive motor 23 continues to drive the second strip drum 6 by an angle of 160°. This phase alternation occurs continuously such that the strip drums 5 and 6 are rotated in a "stop-and-go" operation. A first drum rotates by an angle of 160° and the second drum rests, then the first drum and the second drum rotate by about 20°, and then the first drum rests and the second drum rotates by an angle of 160°. A relative motion between the ripping elements 9 of neighboring strips 7 and 8 of the ripping drums 5 and 6 is achieved by this "stop-and-go" operation of the strip drums 5 and 6 nested into each other such that the bags 34 are safely ripped open and can be emptied well. In addition, it is avoided that windings or other jammings of the ripping drum 4 occur.

If long or difficultly rippable material or pieces, for example, such as hemp strings or video tapes, place themselves around the strips of the ripping drum 4 and tend to be drawn into the slot 24 between the strips 5 and 6, this is prevented by the covering and stripping elements 25, because the covering and stripping elements 25 form an intermittent or, respectively, angular support section against the penetration of the materials or, respectively, form a sectional angular partial covering of the slot 24.

The bevelled front side edge 26 or, respectively, the bevelled back side edge 29 relative to the tangential motion advance direction of the covering and stripping elements forms in each case strippers for the strips 5 and 6 in their neighboring region and assure therewith a function-safe operation of the ripping drum 4. The material to be stripped in the direction of the arrow 34 (FIG. 1) is pushed away from the slot 24 by the selected inclination of the front side edge 26 and of the back side edge 29 of the covering and stripping element 25 relative to the tangential motion advance direction.

It will be understood that each of the elements described above, or two or more together, may also find a useful application in other types of ripping devices differing from the types described above.

While the invention has been illustrated and described as embodied in the context of a device for ripping and tearing bags open, it is not intended to be limited to the details shown, since the various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for ripping bags open comprising a plurality of driven endless rotary support elements;

tearing and ripping elements supported on the endless rotary support elements, wherein the rotary support elements are disposed in an axial direction closely next to each other;

a plurality of covering and/or stripping elements disposed at least at one of the plurality of the rotary support elements, and wherein each of the plurality of the covering and/or stripping elements at least in part overlaps another rotary support element disposed neighboring to said one of the plurality of the rotary support elements.

2. The device according to claim 1, wherein the covering and/or stripping elements are disposed at a distance relative to each other on said one of the plurality of the rotary support elements.

3. The device according to claim 2, wherein the distance between the covering and/or stripping elements is smaller than their length in a tangential motion advance direction of the rotary support elements.

4. The device according to claim 2, wherein the distance between the covering and/or stripping elements is larger than their length in a tangential motion advance direction of the rotary support elements.

5. The device according to claim 1, wherein the covering and/or stripping elements are bevelled on their front edge crosswise to their tangential motion advance direction and such that the front edge of the covering and/or stripping elements relative to the tangential advance motion direction runs in each case from about the respective attachment side obliquely toward the back relative to their tangential motion advance direction.

6. The device according to claim 1, wherein the covering and/or stripping elements are bevelled on their front edge crosswise to their tangential motion advance direction and such that the front edge of the covering and/or stripping elements relative to the tangential advance motion direction runs in each case from about the respective attachment side obliquely curved toward the back relative to their tangential motion advance direction.

7. The device according to claim 1, wherein the covering and/or stripping elements are bevelled on their front edge crosswise to their tangential motion advance direction and such that the front edge of the covering and/or stripping elements relative to the tangential advance motion direction runs in each case from about the respective attachment side slightly arc-shaped toward the back relative to their tangential motion advance direction.

8. The device according to claim 1, wherein the covering and/or stripping elements are bevelled on their back edge crosswise to their tangential motion advance direction and in fact such that the back edge of the covering and/or stripping elements relative to the tangential advance motion direction runs in each case from about their attachment side obliquely toward the front relative to their tangential motion advance direction.

9. The device according to claim 1, wherein the covering and/or stripping elements are bevelled on their back edge crosswise to their tangential motion advance direction and in fact such that the back edge of the covering and/or stripping elements relative to the tangential advance motion direction runs in each case from about their attachment side obliquely curved toward the front, relative to their tangential motion advance direction.

10. The device according to claim 1, wherein the covering and/or stripping elements are bevelled on their back edge crosswise to their tangential motion advance direction and in fact such that the back edge of the covering and/or stripping elements relative to the tangential advance motion direction runs in each case from about their attachment side slightly arc-shaped toward the front, relative to their tangential motion advance direction.

11. The device according to claim 1, wherein the covering and/or stripping elements are formed arch-shaped in the cross-section as seen in the tangential motion advance direction.

12. The device according to claim 1, wherein the covering and/or stripping elements are formed dome-shaped in the cross-section as seen in the tangential motion advance direction.

13. The device according to claim 1, wherein the covering and/or stripping elements are formed gable-shaped in the cross-section as seen in the tangential motion advance direction.

14. A device for ripping open bags comprising a plurality of driven endless rotary support elements supporting tearing and ripping elements, wherein the rotary support elements are disposed closely next to each other, wherein a plurality of covering and/or stripping elements (25) is in each case disposed at least at one of the neighboring rotary support elements (5, 6, 7, 8), and wherein the covering and/or stripping elements (25) at least in part overlap another rotary support element (5, 6, 7, 8) disposed crosswise to the tangential motion advance direction (27).

15. The device according to claim 14, wherein the covering and/or stripping elements (25) are disposed at a distance relative to each other.

16. The device according to claim 15, wherein the distance between the covering and/or stripping elements (25) is smaller than their length in the tangential motion advance direction (27) of the rotary support elements (5, 6, 7, 8).

17. The device according to claim 15, wherein the distance between the covering and/or stripping elements (25) is larger than their length in the tangential motion advance direction (27) of the rotary support elements (5, 6, 7, 8).

18. The device according to claim 14, wherein the covering and/or stripping elements (25) are bevelled on their front edge (26) crosswise to their tangential motion advance direction (27) and in fact such that the front edge (26) of the covering and/or stripping elements (25) relative to the tangential advance motion direction runs in each case from about their attachment side (28) obliquely toward the back or, respectively, obliquely curved and/or slightly arc-shaped toward the back, relative to their tangential motion advance direction (27).

19. The device according to claim 14, wherein the covering and/or stripping elements (25) are bevelled on their back edge (29) crosswise to their tangential motion advance direction and in fact such that the back edge (29) of the covering and/or stripping elements (25) relative to the tangential advance motion direction runs in each case from about their attachment side (28) obliquely toward the front or, respectively, obliquely curved and/or slightly arc-shaped toward the front, relative to their tangential motion advance direction (27).

20. The device according to claim 14, wherein the covering and/or stripping elements (25) are formed arched-shaped, convex-shaped, dome-shaped and/or gable-shaped in the cross-section as seen in the tangential motion advance direction (27).

* * * * *